US005706710A

United States Patent [19]

Chiang

[11] Patent Number: 5,706,710

[45] Date of Patent: Jan. 13, 1998

[54] REVERSIBLE/ADJUSTABLE SPANNER

[76] Inventor: Cho Cheng Chiang, 5F-2, No. 455, Chung Cheng Rd., Yung He City, Taipei Hsien, Taiwan

[21] Appl. No.: 678,562

[22] Filed: Jul. 9, 1996

[51] Int. Cl.[6] ..... B25B 13/22

[52] U.S. Cl. ..... 81/145; 81/94; 81/97

[58] Field of Search ..... 81/92, 94–97, 81/100, 106, 109, 142, 145–147

[56] References Cited

U.S. PATENT DOCUMENTS

| | | | |
|---|---|---|---|
| 654,503 | 7/1900 | Woods | 81/145 X |
| 999,272 | 8/1911 | Stover | 81/146 |
| 1,215,896 | 2/1917 | Ayling | 81/145 X |
| 1,547,443 | 7/1925 | Porter | 81/92 X |

FOREIGN PATENT DOCUMENTS

| | | | |
|---|---|---|---|
| 550599 | 1/1943 | United Kingdom | 81/94 |

*Primary Examiner*—D. S. Meislin

*Attorney, Agent, or Firm*—Charles E. Baxley, Esq.

[57] ABSTRACT

A reversible/adjustable spanner includes an elongate body having a handle and a fixed jaw, a release button mounted above the body, a movable jaw, and an adjusting member. A substantially U-shaped plate is connected to the release button to move therewith and allows the body to extend therethrough. The adjusting member is securely mounted between the body and the U-shaped member and has an upper side with a plurality of teeth for engaging with a plurality of teeth on a bottom side of the body. The movable jaw has a a first end pivotally connected to one of the U-shaped member and the first end of the adjusting member and a second operative end for holding an object to be tightened or loosened between the second operative end and the fixed jaw, wherein a longitudinal movement of the release button causes a change in a distance between the fixed jaw and the movable jaw.

8 Claims, 6 Drawing Sheets

REVERSIBLE/ADJUSTABLE SPANNER

BACKGROUND OF THE INVENTION

1. Field of the Invention

The present invention relates to a reversible/adjustable spanner.

2. Description of the Related Art

Spanners are widely used in daily life and a wide variety thereof have heretofore been provided, e.g., open spanners, ring spanners, adjustable spanners, etc. When using an adjustable spanner, the user has to slowly rotate the adjustment screw until a distance between the fixed jaw and the movable jaw fits an outer diameter of an object to be tightened or loosened, which takes a considerable time. In addition, the adjustable spanner is not reversible such that, after driving the object to be tightened or loosened through a certain angle, the user has to lift the adjustable spanner and then reengage it with the object for further rotation.

Therefore, there has been a long and unfulfilled need for a reversible/adjustable spanner to mitigate and/or obviate the above problems.

SUMMARY OF THE INVENTION

It is an object of the present invention to provide a reversible/adjustable spanner which, when tightening or loosening an object, can be swiftly changed to another position for continuing operation without disengaging from the object.

It is another object of the present invention to provide a reversible/adjustable spanner which may fit objects of different dimensions.

A reversible/adjustable spanner in accordance with the present invention comprises an elongate body, a release button mounted above the body, a movable jaw, and an adjusting member. The elongate body includes a handle formed on a first end thereof and a fixed jaw formed on a second end thereof. The elongate body further includes an upper side and a bottom side with a plurality of first teeth formed thereon.

A substantially U-shaped plate has two side wall sections respectively located outside lateral sides of the body and a mediate portion located below the bottom side of the body, thereby receiving the body therethrough. The side wall sections are securely connected to the release button to move therewith along a longitudinal direction of the body.

The adjusting member has an upper side with a plurality of second teeth for engaging with the first teeth, a bottom side, a first end, and a second end. The adjusting member is securely mounted between the side wall sections of the U-shaped member to move therewith along a longitudinal direction of the body.

The movable jaw has a bottom side, a first end pivotally connected to one of the U-shaped member and the first end of the adjusting member, and a second operative end for holding an object to be tightened or loosened between the second operative end and the fixed jaw, wherein a longitudinal movement of the release button causes a change in a distance between the fixed jaw and the movable jaw.

A biasing means is mounted between the mediate section of the U-shaped member and the adjusting member and has a first end attached to the bottom side of the adjusting member and a second end attached to the bottom side of the movable jaw, thereby biasing the movable jaw and the adjusting member upward.

In a preferred embodiment of the invention, the release button further includes an elastic returning means mounted therein, wherein depression of the release button causes compression of the returning means and causes downward movements of the U-shaped member and the adjusting member to cause disengagement of the second teeth of the adjusting member from the first teeth of the body, thereby allowing relative movement of the movable jaw with respect to the fixed jaw along the longitudinal direction of the body, and wherein release of the release button causes upward movements of the U-shaped member and the adjusting member to cause reengagement of the second teeth of the adjusting member with the first teeth of the body under the action of elasticity of the returning means. Preferably, the returning means includes two U-shaped ends to provide the required returning effect.

In an embodiment of the invention, the returning means includes two wings respectively projecting outwardly from two lateral sides thereof, the release button includes two slots respectively defined in two lateral sides thereof and through which the wings respectively extend, and each of the side wall sections of the U-shaped member includes a second slot defined in an upper end thereof and through which an associated wing extends.

Preferably, the adjusting member includes an arcuate concave, and the first end of the movable jaw is cylindrical so as to be received in the second arcuate concave such that the movable jaw is pivotal relative to the first end of the adjusting member about an axis of the cylindrical first end. The cylindrical first end of the movable jaw includes two knobs at two sides thereof, and each of the side wall sections includes an opening defined therein for pivotally receiving the associated knob.

Preferably, the bottom side of the adjusting member includes a notch defined therein for receiving the first end of the biasing means, and the second end of the biasing means is attached to the bottom side of the movable jaw and adjacent to the first end of the movable jaw.

In an embodiment of the invention, the adjusting member includes a protrusion formed on each of two lateral sides thereof, and each of the side wall sections of the U-shaped member includes an opening for fittingly receiving the associated protrusion on the adjusting member.

Other objects, advantages, and novel features of the invention will become more apparent from the following detailed description when taken in conjunction with the accompanying drawings.

DESCRIPTION OF THE PREFERRED EMBODIMENT

Figure 1:
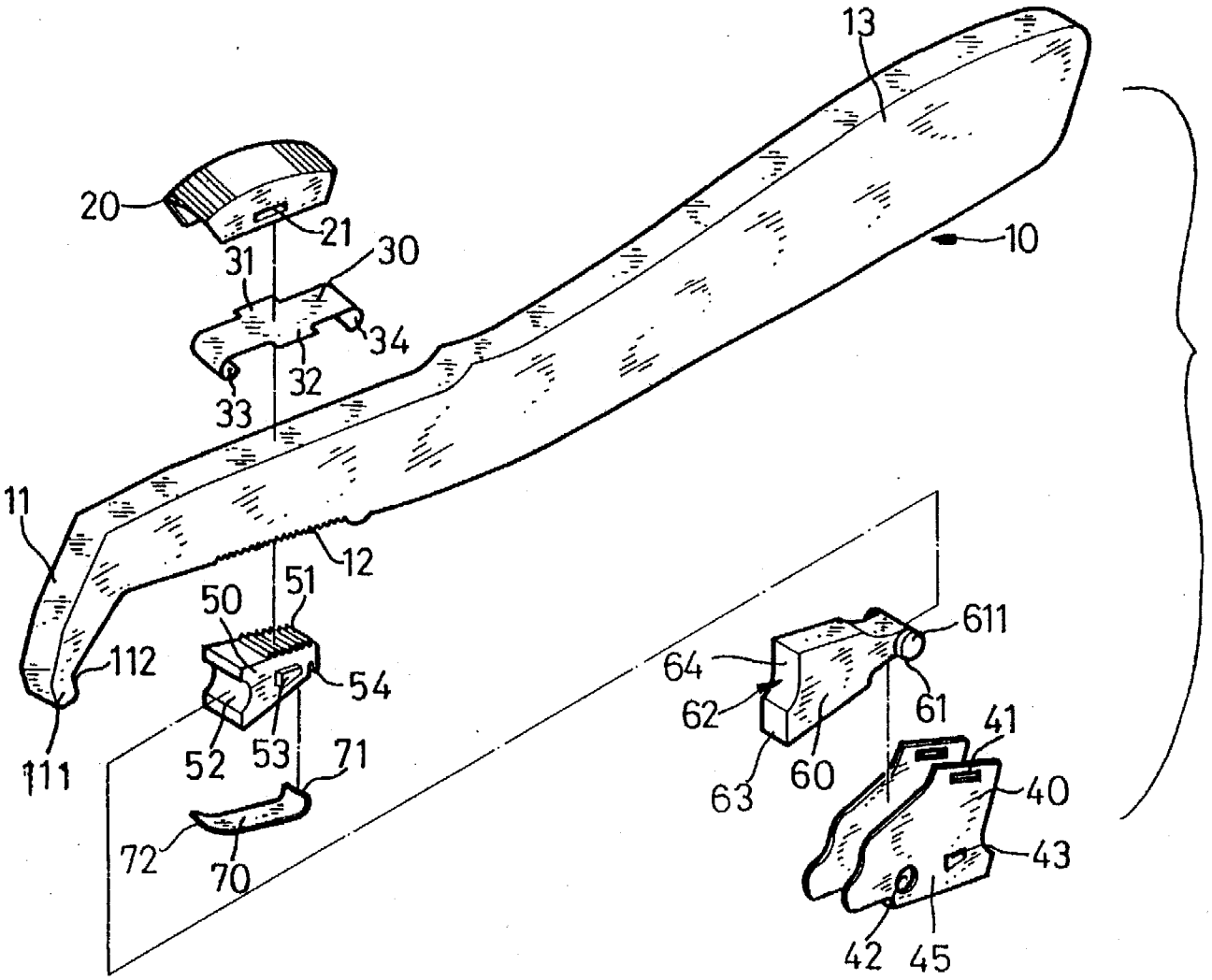
FIG. 1 is an exploded perspective view of a reversible/adjustable spanner in accordance with the present invention.
Figure 2:
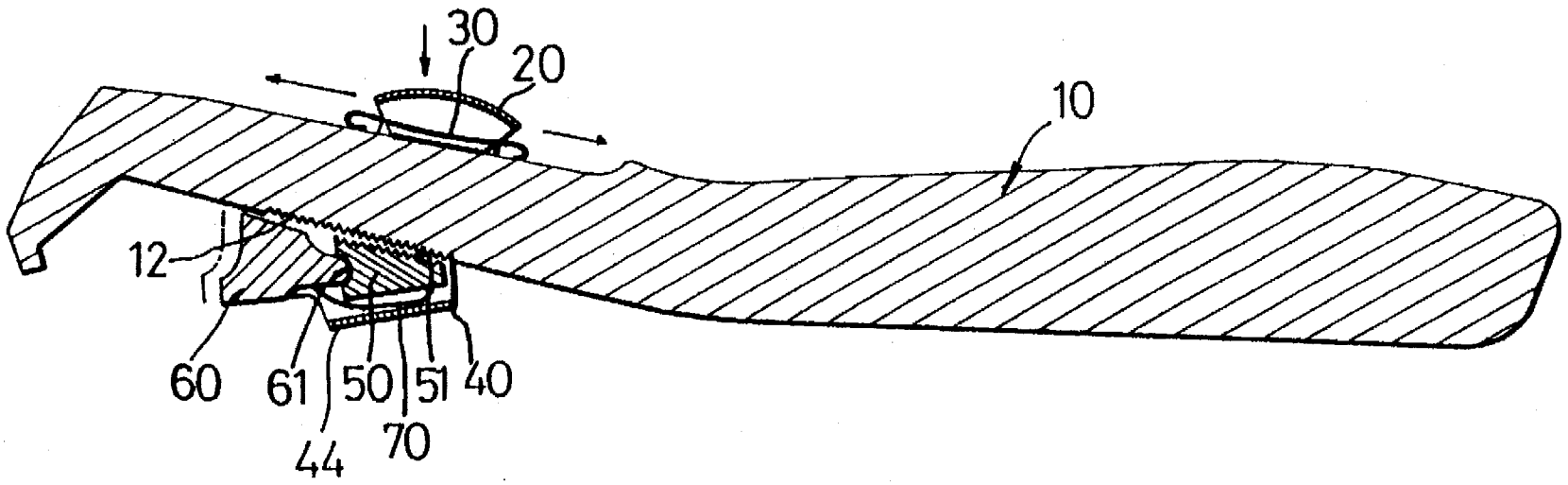
FIG. 2 is a cross-sectional view of the reversible/adjustable spanner.

Referring to the drawings and initially to FIGS. 1 and 2, a reversible/adjustable spanner in accordance with the present invention generally includes an elongate body 10 having a handle 13 formed on a first end thereof, a fixed jaw 11 formed on a second end thereof, and a movable jaw 60. The fixed jaw 11 includes a hooked end 111 with an engaging face 112. The elongate body 10 further includes a bottom side having a plurality of first teeth 12 thereon.

The reversible/adjustable spanner further includes an adjusting member 50 having first and second ends, an upper side with a plurality of second teeth 51 for engaging with the first teeth 12, and a bottom side having a notch 54 defined therein adjacent to the second end thereof.

The movable jaw 60 includes a first end 61 pivotally connected to the first end of the adjusting member 50 and a second operative end 62 for holding an object to be tightened or loosened between the second operative end 62 and the engaging face 112 of the fixed jaw 11. The second operative end 62 includes a planar section 63 and an arcuate concave section 64 which will be described in detail later. The first end of the adjusting member 50 includes an arcuate concave 52, and the first end 61 of the movable jaw 60 is cylindrical so as to be received in the arcuate concave 52 so that the movable jaw 60 is pivotal relative to the first end of the adjusting member 50 about an axis of the cylindrical first end 61.

A release button 20 is mounted above the body 10. A substantially U-shaped plate 40 includes two side wall sections 45 (see FIG. 1) respectively located outside the lateral sides of the body and a mediate portion 44 (see FIG. 2) located below the bottom side of the body 10, thereby receiving the body 10 therethrough. As shown in FIG. 2, the adjusting member 50 is securely mounted between the side wall sections 45 to move therewith along a longitudinal direction of the body 10. The side wall sections 45 of the U-shaped plate 40 are connected to the release button 20 at upper ends thereof to move therewith along the longitudinal direction of the body 10, whereby longitudinal movement of the release button 20 causes a change in a distance between the fixed jaw 11 and the movable jaw 60 which will be described in detail later.

In this embodiment, the adjusting member 50 includes a protrusion 53 formed on each of two lateral sides thereof, and each of the side wall sections 45 of the U-shaped member 40 includes an opening 43 for fittingly receiving the associated protrusion 53 on the adjusting member 50. In a preferred embodiment of the invention, the cylindrical first end 61 includes two knobs 611 at two sides thereof so as to be respectively pivotally received in two openings 42 respectively defined in the side wall sections 45.

Still referring to FIGS. 1 and 2, a biasing means 70 is mounted between the mediate section 44 of the U-shaped member 40 and the bottom side of the adjusting member 50 and has a first end 71 (see FIG. 1) attached to the adjusting member 50 and a second end 72 attached to the movable jaw 60, thereby biasing the movable jaw 60 and the adjusting member 50 upward. The first end 71 of the biasing means 70 is received in the notch 54 of the bottom side of the adjusting member 50, while the second end of the biasing means 70 is attached to the bottom side of the movable jaw 60 and adjacent to the first end of the movable jaw 60.

The release button 20 further includes an elastic returning means 30 mounted therein, wherein the returning means includes two wings 31 and 32 respectively projecting outwardly from two lateral sides thereof. The release button 20 includes two slots 21 respectively defined in two lateral sides thereof and through which the wings 31 and 32 respectively extend, and each of the side wall sections 45 of the U-shaped member 40 includes a second slot 41 defined in the upper end thereof and through which an associated wing 31, 32 extends.

In assembly, the protrusions 53 of the adjusting member 50 are inserted into the openings 43 of the U-shaped member 40. Then, the knobs 611 of the movable jaw 60 are inserted into the holes 42 of the U-shaped member 40 with the cylindrical first end 61 bearing against the arcuate concave 52 of the adjusting member 50. Thereafter, the first end 71 of the biasing means 70 is mounted into the notch 54 of the adjusting member 50 and the second end of the biasing means 70 is attached to the bottom side of the movable jaw 60. Then, the U-shaped member 40 is mounted around the body 10 in a manner described in the above, in which the second teeth 51 of the adjusting member 50 engages with the first teeth 12 of the body 10. The returning means 30 is then mounted above the body 10 and the release button 20 is mounted above the returning means 30. Thereafter, the wings 31 and 32 are respectively inserted into the associated slots 21 and 41 and then bent downwardly to avoid disengagement therebetween.

By such an arrangement, depression of the release button 20 causes compression of the returning means and causes downward movements of the U-shaped member 40 and the adjusting member 50 to cause disengagement of the second teeth 51 of the adjusting member 50 from the first teeth 12 of the body 10 (see FIG. 2), thereby allowing relative longitudinal movement of the movable jaw 60 with respect to the fixed jaw 11. When the release button 20 is released, the U-shaped member 40 and the adjusting member 50 move upwardly to cause reengagement of the second teeth 51 of the adjusting member 50 with the first teeth 12 of the body 10 under the action of elasticity of the returning means 30. Thus, the spanner of the invention can be swiftly adjusted to fit objects of different diameters. In this embodiment, the returning means 30 includes two U-shaped ends 33 and 34 to provide the required returning effect.

Figure 3:
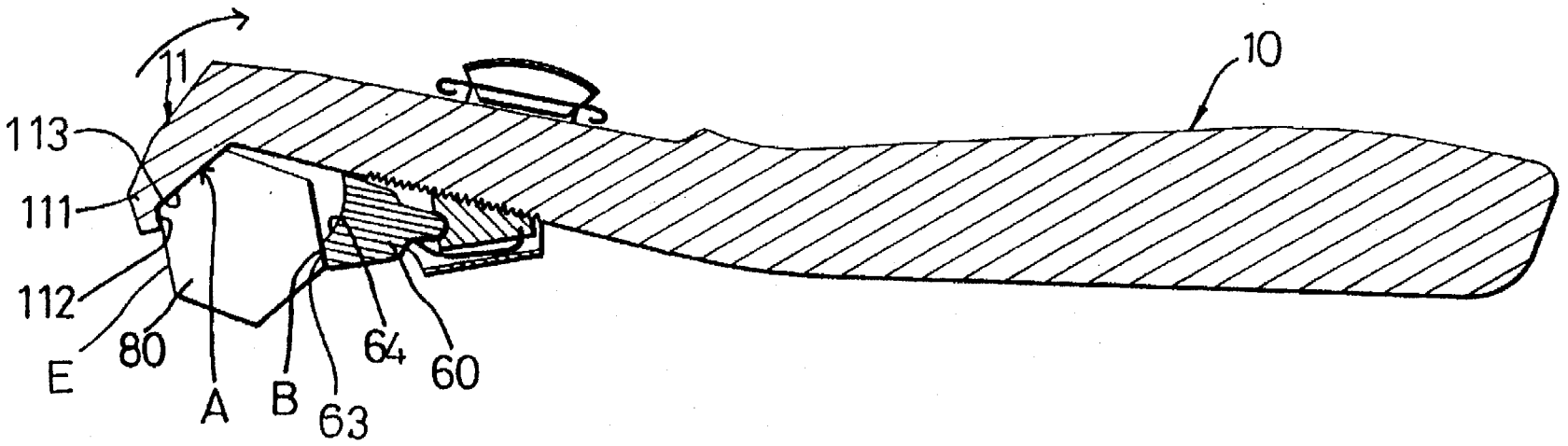
FIGS. 3–6 are cross-sectional views illustrating operations of the reversible/adjustable spanner.

Referring now to FIGS. 3 to 6 and initially to FIG. 3, when the spanner of the invention is used to tighten or loosen an object, e.g., a hexagonal bolt, a bolt head 80 of the hexagonal bolt is securely held between the fixed jaw 11 and the movable jaw 60 in which a side "E" of the bolt head 80 engages with the engaging face 112 of the hooked end 111 of the fixed jaw 11, side "A" engages with another engaging face 113 of the fixed jaw, and the planar section 63 of the movable jaw 60 bears against another side "B" of the bolt head 80. When the spanner is rotated through a certain angle along a direction (e.g., clockwise) indicated by the arrow of FIG. 3, the bolt head 80 is also rotated through the certain angle.

Figure 4:
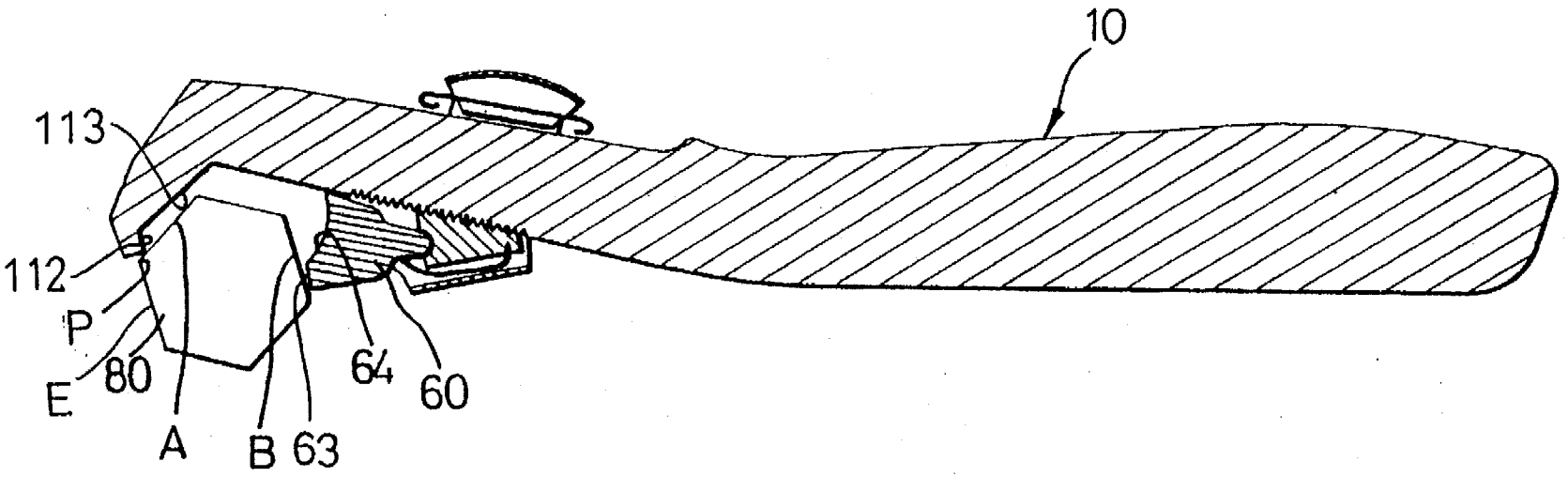

Nevertheless, the spanner of the invention is reversible by simply rotating the spanner in the other direction. As shown in FIG. 4, when the spanner is rotated counterclockwise, a vertex "P" between sides "A" and "E" of the bolt head 80 moves beyond the fixed jaw (i.e., side "A" disengages from the engaging face 113, and side "E" disengages from the engaging face 112), while the movable jaw 60 has not yet moved.

Figure 5:
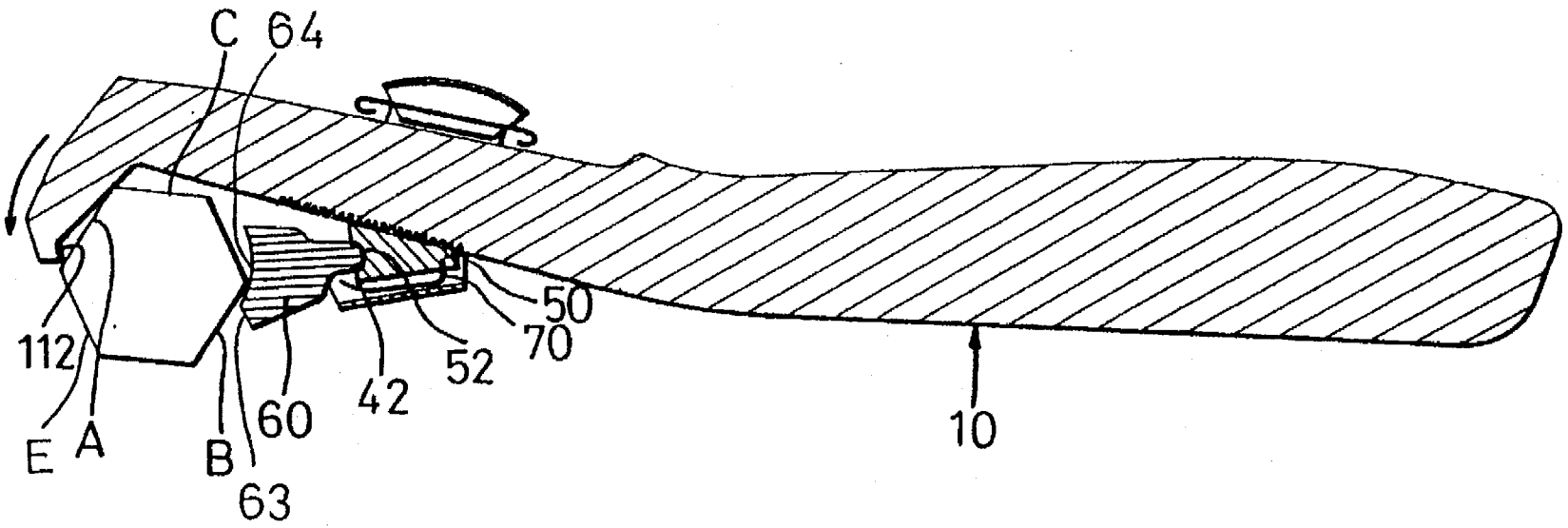
Figure 6:
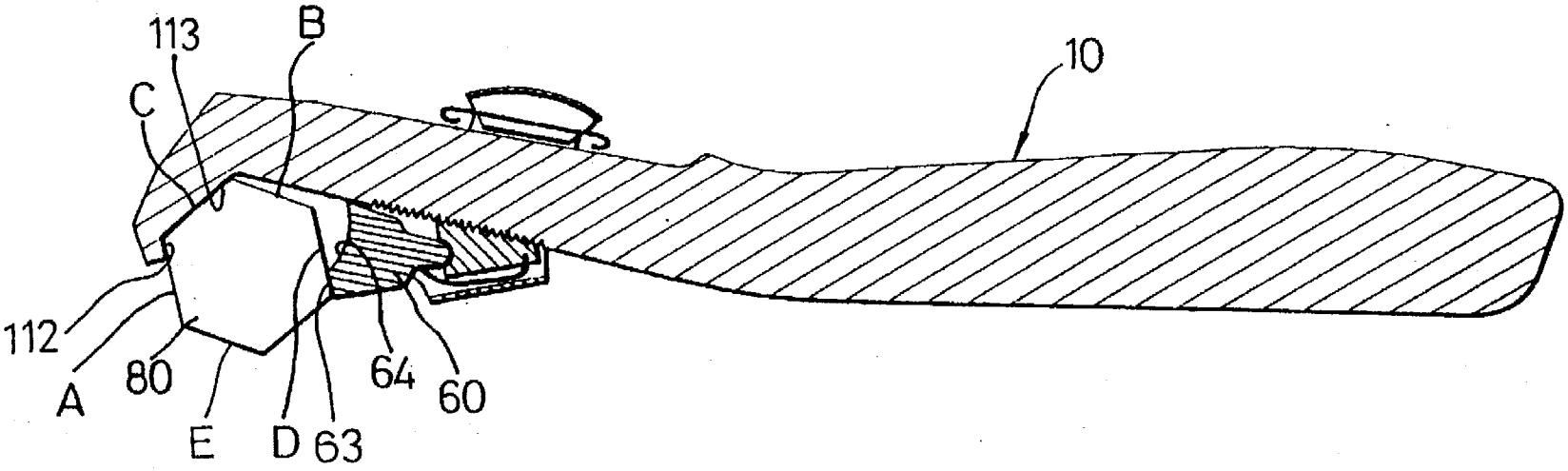

Further counterclockwise rotation of the spanner results in pivotal movement of the movable jaw 60 (the movable jaw 60 slightly moves downwardly), such that the arcuate concave section of the movable jaw 60 engages with the bolt head 80 instead of the planar section 63, as shown in FIG. 5. Referring to FIG. 6, further counterclockwise rotation of the spanner results in pivotal movement of the movable jaw 60 until another side "C" of the bolt head 80 engages with the engaging face 113, the side "A" engages with the engaging face 112, while the movable jaw 60 bears against a side "D". This is because the movable jaw 60 is pivotally connected to the holes 42 of the U-shaped member 42 and abuts against the arcuate concave 52 of the adjusting member 50, and can be returned to its initial position under the action of the biasing means 70. As shown in FIG. 6, the spanner is now ready for being rotated in the clockwise rotation for further tightening or loosening the bolt.

Although the invention has been explained in relation to its preferred embodiment, it is to be understood that many other possible modifications and variations can be made without departing from the spirit and scope of the invention as hereinafter claimed.

What is claimed is:

1. A reversible/adjustable spanner comprising:

an elongate body having a handle formed on a first end thereof and a fixed jaw formed on a second end thereof, the elongate body further including an upper side, a bottom side with a plurality of first teeth formed thereon, and two lateral sides;

a release button mounted above the body;

a substantially U-shaped plate having two side wall sections respectively located outside the lateral sides of the body and a mediate portion located below the bottom side of the body, thereby receiving the body therethrough, the side wall sections being securely connected to the release button to move therewith along a longitudinal direction of the body;

an adjusting member having an upper side with a plurality of second teeth for engaging with the first teeth, a bottom side, a first end, and a second end, the adjusting member being securely mounted between the side wall sections of the U-shaped member to move therewith along a longitudinal direction of the body;

a movable jaw having a bottom side, a first end pivotally connected to one of the U-shaped member and the first end of the adjusting member, and a second operative end for holding an object to be tightened or loosened between the second operative end and the fixed jaw, wherein a longitudinal movement of the release button causes a change in a distance between the fixed jaw and the movable jaw; and a biasing means mounted between the mediate section of the U-shaped member and the adjusting member and having a first end attached to the bottom side of the adjusting member and a second end attached to the bottom side of the movable jaw, thereby biasing the movable jaw and the adjusting member upward.

2. The reversible/adjustable spanner as claimed in claim 1, wherein the release button further includes an elastic returning means mounted therein, wherein depression of the release button causes compression of the returning means and causes downward movements of the U-shaped member and the adjusting member to cause disengagement of the second teeth of the adjusting member from the first teeth of the body, thereby allowing relative movement of the movable jaw with respect to the fixed jaw along the longitudinal direction of the body, and wherein release of the release button causes upward movements of the U-shaped member and the adjusting member to cause reengagement of the second teeth of the adjusting member with the first teeth of the body under the action of elasticity of the returning means.

3. The reversible/adjustable spanner as claimed in claim 2, wherein the returning means includes two U-shaped ends.

4. The reversible/adjustable spanner as claimed in claim 2, wherein the returning means includes two wings respectively projecting outwardly from two lateral sides thereof, the release button includes two slots respectively defined in two lateral sides thereof and through which the wings respectively extend, and each of the side wall sections of the U-shaped member includes a second slot defined in an upper end thereof and through which an associated said wing extends.

5. The reversible/adjustable spanner as claimed in claim 1, wherein the first end of the adjusting member includes an arcuate concave, and the first end of the movable jaw is cylindrical so as to be received in the second arcuate concave such that the movable jaw is pivotal relative to the first end of the adjusting member about an axis of the cylindrical first end.

6. The reversible/adjustable spanner as claimed in claim 5, wherein the cylindrical first end of the movable jaw includes two knobs at two sides thereof, and each of the side wall sections includes an opening defined therein for pivotally receiving the associated knob.

7. The reversible/adjustable spanner as claimed in claim 5, wherein the bottom side of the adjusting member includes a notch defined therein for receiving the first end of the biasing means, and the second end of the biasing means is attached to the bottom side of the movable jaw and adjacent to the first end of the movable jaw.

8. The reversible/adjustable spanner as claimed in claim 1, wherein the adjusting member includes a protrusion formed on each of two lateral sides thereof, and each of the side wall sections of the U-shaped member includes an opening for fittingly receiving the associated protrusion on the adjusting member.

* * * * *